US005125031A

United States Patent [19]

Ledonne

[11] Patent Number: 5,125,031

[45] Date of Patent: Jun. 23, 1992

[54] SPEAKER SYSTEM WITH FOCUSED VIBRATION

[76] Inventor: Robert Ledonne, 9707 Ross Station Rd., Sebastopol, Calif. 95472

[21] Appl. No.: 745,002

[22] Filed: Aug. 14, 1991

[51] Int. Cl.[5] ..... H04R 25/00

[52] U.S. Cl. ..... 381/152; 381/162; 381/24; 181/161

[58] Field of Search ..... 381/24, 25, 151, 152, 381/163, 158, 162; 181/153, 161

[56] References Cited

U.S. PATENT DOCUMENTS

| | | | |
|---|---|---|---|
| 1,683,178 | 9/1928 | Gibbs | 181/161 |
| 1,950,857 | 3/1934 | McGall | 381/162 |
| 4,064,376 | 12/1977 | Yamada | 381/152 |
| 4,757,548 | 7/1988 | Fenner, Jr. | 381/152 |
| 4,957,184 | 9/1990 | Ne Gishi | 181/153 |
| 4,961,227 | 10/1990 | Ledonne | 381/24 |

*Primary Examiner*—Jin F. Ng
*Assistant Examiner*—Huyen D. Le
*Attorney, Agent, or Firm*—Flehr, Hohbach, Test, Albritton & Herbert

[57] ABSTRACT

A loud speaker vibration transmitting apparatus has a speaker housing which encloses a speaker cone which vibrates within the housing and a propagation member which has a first contact end in contact with the speaker cone. In one embodiment, the propagation member extends out of the housing so that the vibration of the speaker cone can be directly transmitted out of the housing while the vibration also can be propagated into the housing. In another embodiment, the housing is designed to maintain a vacuum inside of the housing so that the vibrations of the speaker cone are propagated to the surface of the housing through the propagation member without transmitting audible sounds from the housing.

19 Claims, 5 Drawing Sheets

SPEAKER SYSTEM WITH FOCUSED VIBRATION

The present invention relates generally to a vibration loud speaker system. More particularly, the present invention relates to such a speaker system that produces vibrations that can be directly felt by a user. This invention is both an improvement to and related to my prior U.S. Pat. No. 4,961,227, issued Oct. 2, 1990.

BACKGROUND OF THE INVENTION

Loud speaker drivers include the following components: an electromagnet; a moving voice coil; and a speaker cone attached to the coil. The speaker driver components operate together to generate audible sounds, such as music or voice transmissions. The electromagnet receives sound transmissions in the form of electrical signals from a sound amplifier. The variations in the signal frequency and amplitude causes the magnetic flux of the magnet to change in response thereto. The moving voice coil and the speaker cone, responsive to the changes in magnetic flux, move in a manner characteristic of the frequency and amplitude of the signal.

The speaker cone is the actual component which is responsible for converting the electrical signals into audible sound. The movement of the speaker cone displaces the air in the vicinity of the speaker cone. The displaced air creates sound waves having an amplitude and frequency indicative of those from the electrical signal, and in this manner, the desired audible sound reproduction is achieved.

The loud speaker drivers are typically enclosed in a sturdy, non-vibrational housing. The electromagnet and voice coil are recessed into the housing and the face of the speaker cone is generally focused outward from the housing to direct the audible sound outward into the listening area. A perforated grill made of a rigid material, such as plastic or metal, or an acoustically transparent foam is placed over the exposed surface of the speaker cone to protect it.

It is known in the audio reproduction art that the transmissions of vibrations to the body intensifies the enjoyment of listening to music. For example, in U.S. Pat. Nos. 4,064,376 and 4,354,067 two devices for the implantation of an vibration device within a the seat and backrest respectively of a chair are disclosed. The audio sensation created by the vibrations transmitted through the body cavity of the person sitting in the chair intensifies the enjoyment of the music. In U.S. Pat. No. 4,757,548, a speaker which transmits sonic vibrations to liquid and solid media is disclosed. U.S. Pat. No. 4,778,027 teaches the placement of speakers faced toward a surface to be vibrated. During operation, the sonic energy generated by the speaker is transmitted to the surface causing it to vibrate.

It is also known in the audio reproduction art to use sound induced vibrations to aid the hearing impaired. In U.S. Pat. Nos. 3,423,544 and 2,858,376 respectively, two electro-acoustic bone conduction receivers mounted onto the elongated portion of eye glasses are disclosed. The bone conduction receiver as described in both of these references is an electro-mechanical device which transforms electric currents into mechanical vibrations and transmits the latter to the bones of the skull of the wearer of the glasses in the vicinity of the ear. This process of transmitting sounds to the inner ear of a deaf person is known to give good results in many instances where the inner ear is in reasonably good condition, although the middle ear may be seriously defective.

In U.S. Pat. No. 4,961,227, a loud speaker system includes a speaker cone, a propagation member and a vibrational housing which encloses the speaker cone and the propagation member. The vibrations on the speaker cone are transmitted to the vibrational housing through the propagation member.

In some settings, it is desirable that the vibrations from a loud speaker be directly felt by a human body in more accurate and focused fashion. For example, the human body's feeling of the vibrations generated by music can be used to convey rhythm, timing and steps to the deaf. In another example, when a person listens a music, the body feeling towards vibrations of the loud speaker enables the person to sense how hard and how quick the player strikes the keys of a piano. In some other settings, in addition to the requirements of more accurate and focused vibration transmission, it is also desirable to transmit the vibrations from the loud speaker to the human body without transmitting audible sounds from the loud speaker. For example, loud speakers can be installed in a chair so a person sitting in the chair can feel the vibrations without disturbing others.

SUMMARY OF THE INVENTION

Accordingly, it is a primary object of the present invention to provide an improved apparatus for transmitting vibrations from a loud speaker to a user's body.

It is another object of the present invention to provide an apparatus which is capable of transmitting vibrations from the loud speaker to the user's body in a more accurate fashion. As used herein, the term "more accurate fashion" means that the frequency spectrum of the transmitted vibrations is close to that of the vibrations as produced by the loud speaker.

It is another object of the present invention to provide an apparatus which is capable of transmitting vibrations from the loud speaker in a more focused fashion.

It is yet another object of the present invention to provide an apparatus which is capable of transmitting vibrations from the loud speaker without transmitting audible sounds from the loud speaker.

In one embodiment of the invention, a speaker in the system includes a loud speaker housing for enclosing a speaker cone which vibrates within the housing and a propagation member which contacts the speaker cone. The propagation member is designed to extend out of the housing so that the vibration of the speaker cone is directly transmitted out of the housing while the vibration also is propagated into the surface of the housing.

In another embodiment of the invention, the housing is designed to maintain a vacuum inside of the housing so that the vibrations of the speaker cone are propagated to the surface of the housing through the propagation member without transmitting audible sounds out of the housing.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
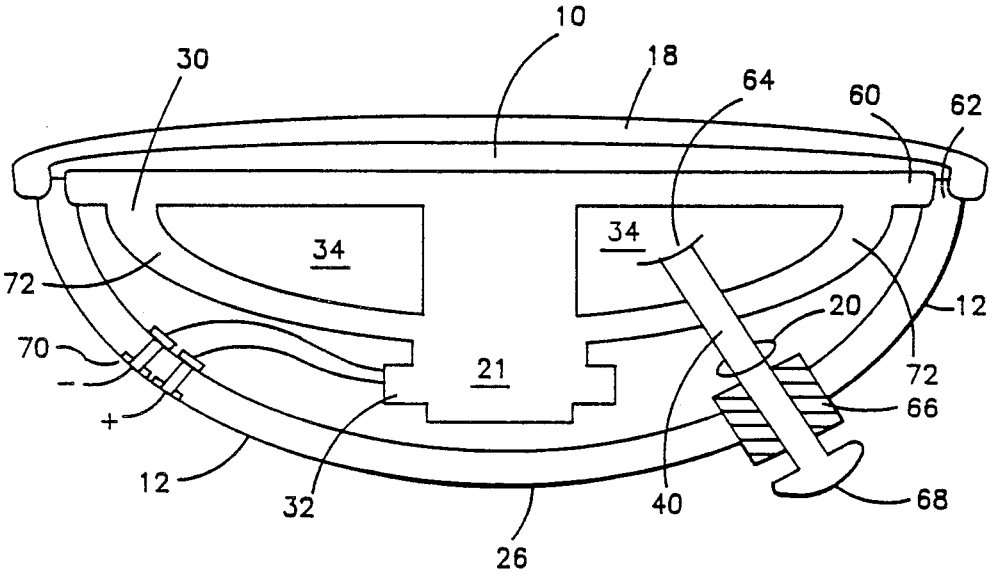
FIG. 1 is a cross-section view of a speaker showing one embodiment in accordance with the invention.

Reference is initially made to FIG. 1 which illustrates a cross-section view of a speaker showing one embodiment in accordance with the invention. Speaker 10 includes speaker driver 21, speaker cone 34 and shaft 40, and is fixed within housing 12 through engaging speaker frame flange 60 into notch 62 of the housing. Speaker driver 21 includes a structural frame 30, a magnet 32, a conventional moving voice coil (not shown) and a speaker cone 34. Driver 21 is situated within the housing 12 so that speaker cone 34 is focused outward to direct audible sound through grill 18 of housing 12. The remainder of the driver, including magnet 32 and the voice coil are recessed within housing 12. Speaker cone 34 is made of paper, polypropylene or any other material suitable for sound reproduction.

The mechanism for transmitting the vibration from speaker cone 34 out of housing 12 includes speaker cone 34, shaft 40 and a tube 66 installed on the housing 12. One end of shaft 40 connects to the speaker cone 34, and the distal end of shaft 40 extends out of housing 12 through tube 66. At attachment area 64, shaft 40 and speaker cone 34 are attached by glue, epoxy or other fastening means to the underside of speaker cone 34. Ring clamp 20 is installed on shaft 40 at the vicinity of tube 66 to prevent the shaft 40 from being pulled out by a user. Housing 12 and tube 66 are made of vibration transmitting materials. When speaker cone 34 vibrates during speaker operation, shaft 40 vibrates along tube 66, thus propagating the speaker cone vibrations to section 26 of housing 12 through the wall of tube 66. Accordingly, shaft 40 and section 26 the of housing 12 vibrate in harmony with the audible sounds generated by the speaker driver 21. The vibrations from speaker cone 34 can be felt either by touching section 26 of housing 12 or cap 68, which is mounted on the distal end of shaft 40. A receptacle 70 is installed in the wall of housing 12 for connecting a signal from an amplifier to drive the speaker. Housing 12 may have holes (not shown) on it so that the air can be displaced out of the housing while the speaker cone is vibrating.

In order to intensify vibrations on shaft 40, tube 66 can alternatively be made from non-vibrational material so that tube 66 will not propagate vibration to section 26 of housing 12 when shaft 40 vibrates along tube 66. As an additional alternative, housing 26 can also be made from non-vibrating material to prevent the housing from vibrating. The structure in FIG. 1 has several variations. The same numerals will be used for the same parts in the other embodiments elaborated herein after so that repeated explanation can be avoided.

Figure 2:
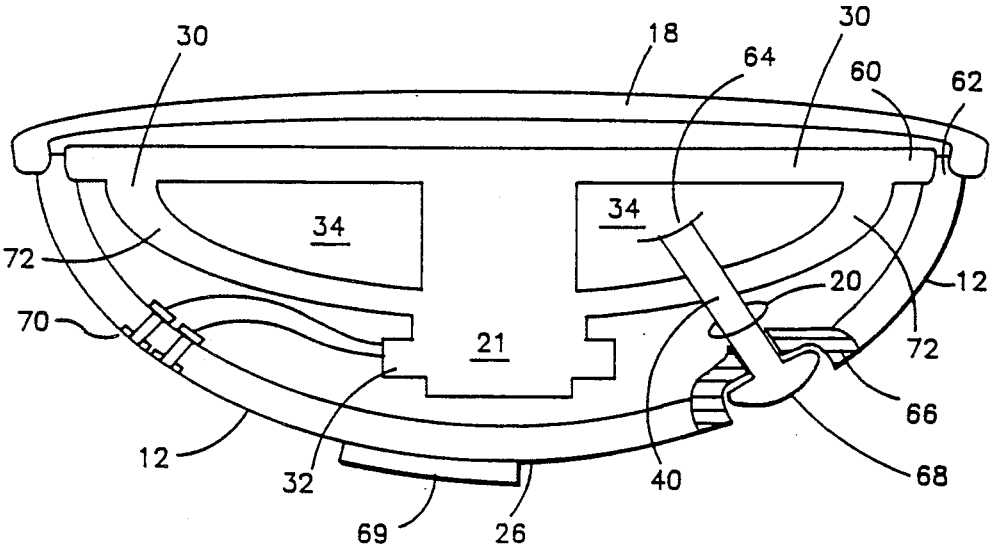
FIG. 2 illustrates a variation of the speaker shown in FIG. 1.

FIG. 2 illustrates another embodiment where tube 66 is installed on housing 12 in such way so that cap 68 mounted on the distal end of shaft 40 is flush with the housing 12. It should be noticed that, if housing 12 and tube 66 are made of vibrational materials, there are also two levels of vibrations here: 1) the vibration on cap 68 which is directly from speaker cone 34, and 2) the vibration on section 26 of housing 12 which is propagated through tube 66. Thus, by touching cap 68, one can feel more focused and intense vibration; by touching section 26 of the housing, one can feel more diffuse vibration. Therefore, by touching different parts of the housing, one can obtain different sensitivity. As an option, a non-vibrational material covering 69 can be used to slip over housing 12, but not cap 68. Thus, by using the accessory, the user feels only one level of vibration; by removing the accessory, the user can feel the two levels of vibration at the same time.

Figure 3:
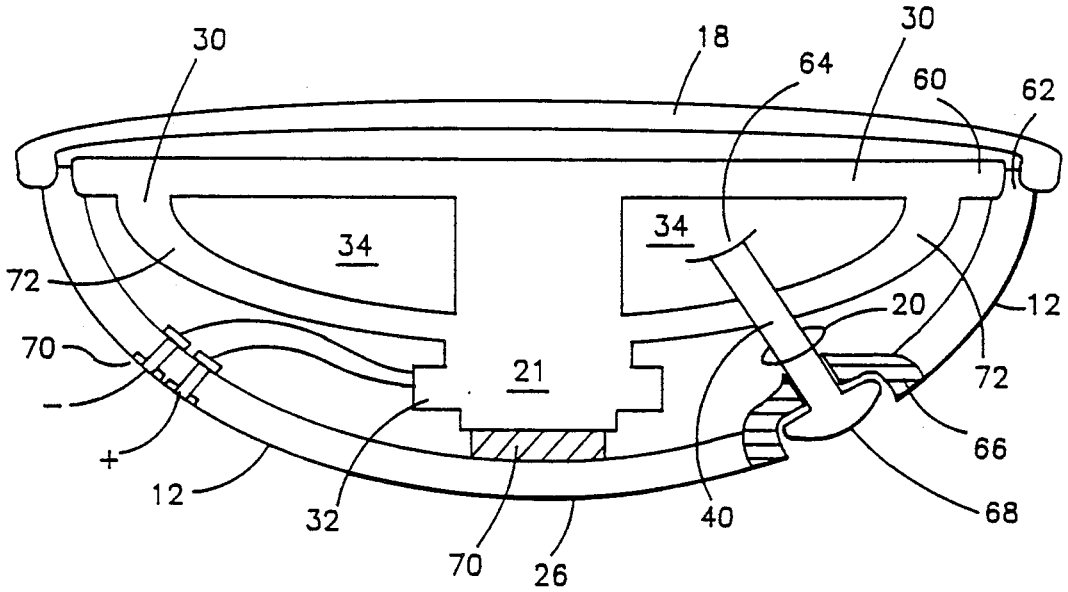
FIG. 3 is a cross-section view of a speaker showing another embodiment in accordance with the invention.

FIG. 3 is a cross-section view of a speaker showing another embodiment in accordance with the invention. In FIG. 3, instead of engaging the frame flange into the notch of the housing, the loud speaker is fixed within housing 12 by gluing bottom 70 of driver 21 to housing 12. When speaker cone 34 vibrates, the section 72 of speaker frame 30 as shown in FIGS. 1 and 2 may vibrate accordingly because the position of section 72 is susceptible to vibrations. In the structure shown in FIG. 1, the vibrations of speaker cone 34 may be transmitted into housing 12 through frame flange 60. Thus, in the structure as shown in FIG. 1, even the vibrations of shaft 40 is isolated from housing by tube 66 which is made from non-vibrational material, the vibrations of speaker cone 34 may still be transmitted into housing 12 through frame flange 60. In the structure shown in FIG. 3, however, there is no frame flange 60 connected to housing 12. Thus, in the structure as shown in FIG. 3, if the vibrations of shaft 40 is isolated from housing by the tube 66 being made from non-vibrational material, no vibrations of speaker cone 34 will be transmitted into housing 12, thus intensifying the vibrations of cap 68.

Figure 4:
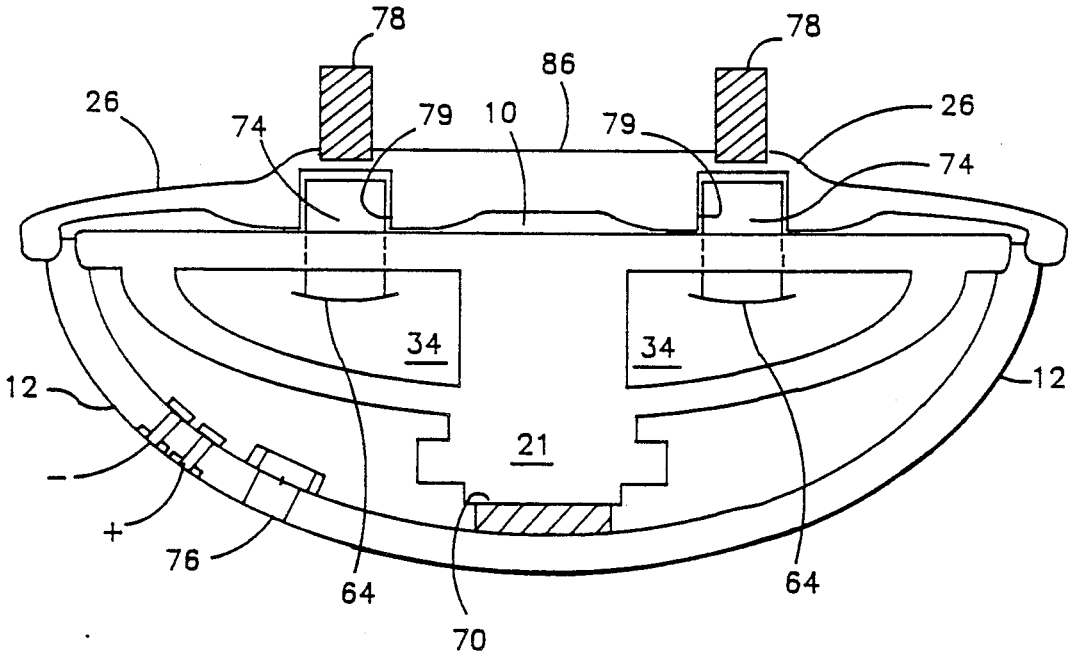
FIG. 4 is a cross-section view of a speaker showing another embodiment in accordance with the invention.

FIG. 4 illustrates an embodiment which transmits the loud speaker's vibrations to its housing without transmitting audible sounds from the housing. Housing 12 encloses speaker 10 which includes speaker driver 21, speaker cone 34, and shafts 74. The speaker is fixed within the housing by gluing bottom 70 of driver 21 within housing 12. Two hollow protrusions 79 are located on the inside surface of the housing; and two bolts 78 are installed on the top of the housing for firmly attaching the housing to other object. Enclosed housing 12, made of vibration transmitting material, is hermetically sealed to allow a vacuum to be maintained by withdrawing air from valve 76.

The mechanism for transmitting the vibrations includes speaker cone 34, the two shafts 74 and two hollow protrusions 79 located on the inside surface of housing 12. One end of the shafts 74 is connected to speaker cone 34, and the other end of the shafts 74 extends to contact the inside wall of the hollow protrusions 79. At attachment areas 64, shafts 74 and speaker cone 34 are attached by glue, epoxy or other fastening means to the inside of speaker cone 34. When speaker cone 34 vibrates during speaker operation, shafts 74 vibrate the inside wall of hollow protrusions 79, thus propagating the speaker cone vibrations to portion 86 of the housing 12 through the inside wall of hollow protrusions 79. Accordingly, shafts 74 and section 86 of housing 12 vibrate in harmony with the vibrations generated by the speaker driver 21. Since housing 12 maintains a vacuum inside of the housing, the vibrations of speaker cone 34 will not generate audible sounds outside housing 12.

Figure 5A:
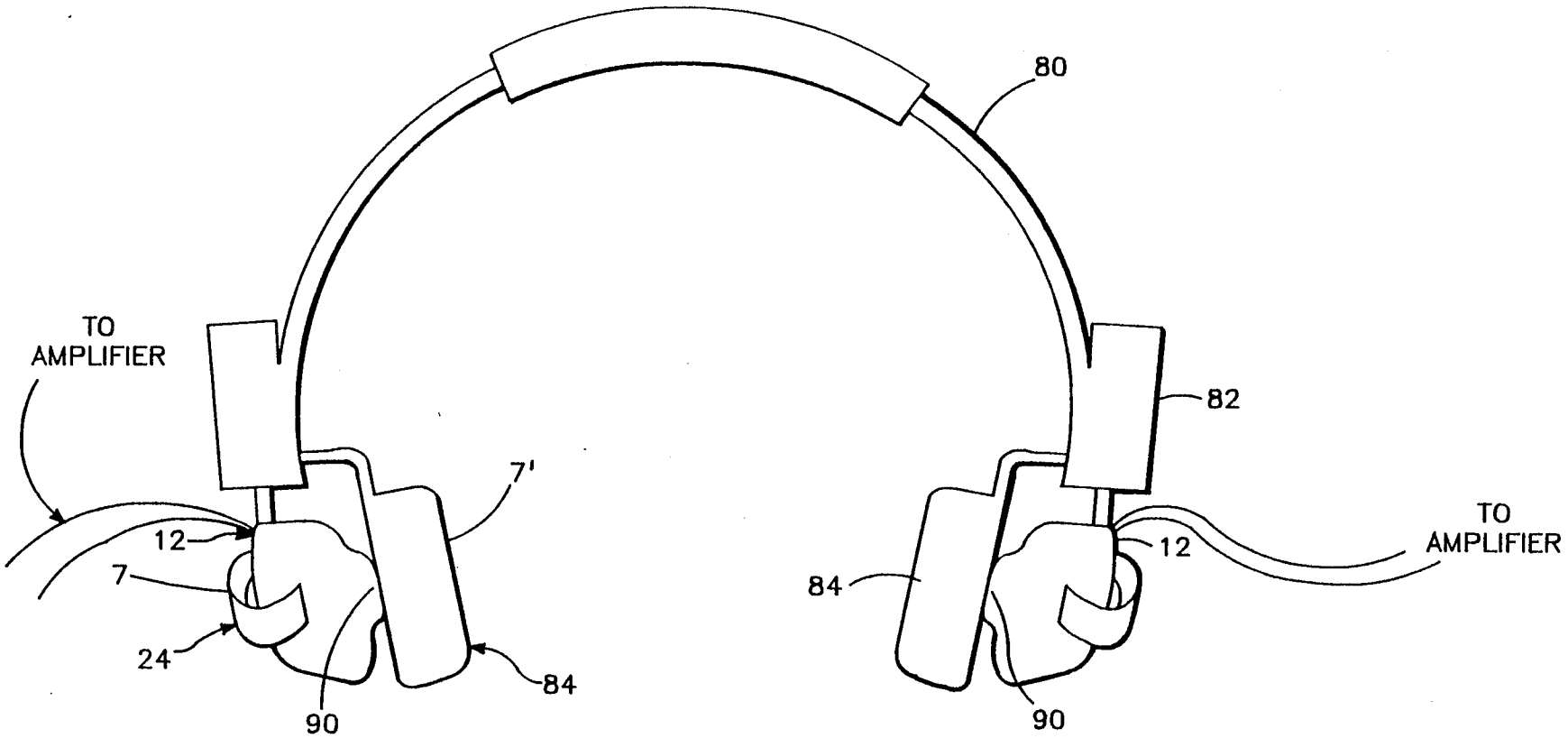
FIG. 5A is a perspective view of the vibrational speaker shown in FIG. 4 for use with a stereo headset.

Referring now to FIG. 5A, the vibrational speaker of FIG. 4 is shown within a stereo headset 80. Vibrating section 90 of housing 12 touches ear pad 84 for propagating vibration from the housing 12 to the pad 84.

Figure 5B:
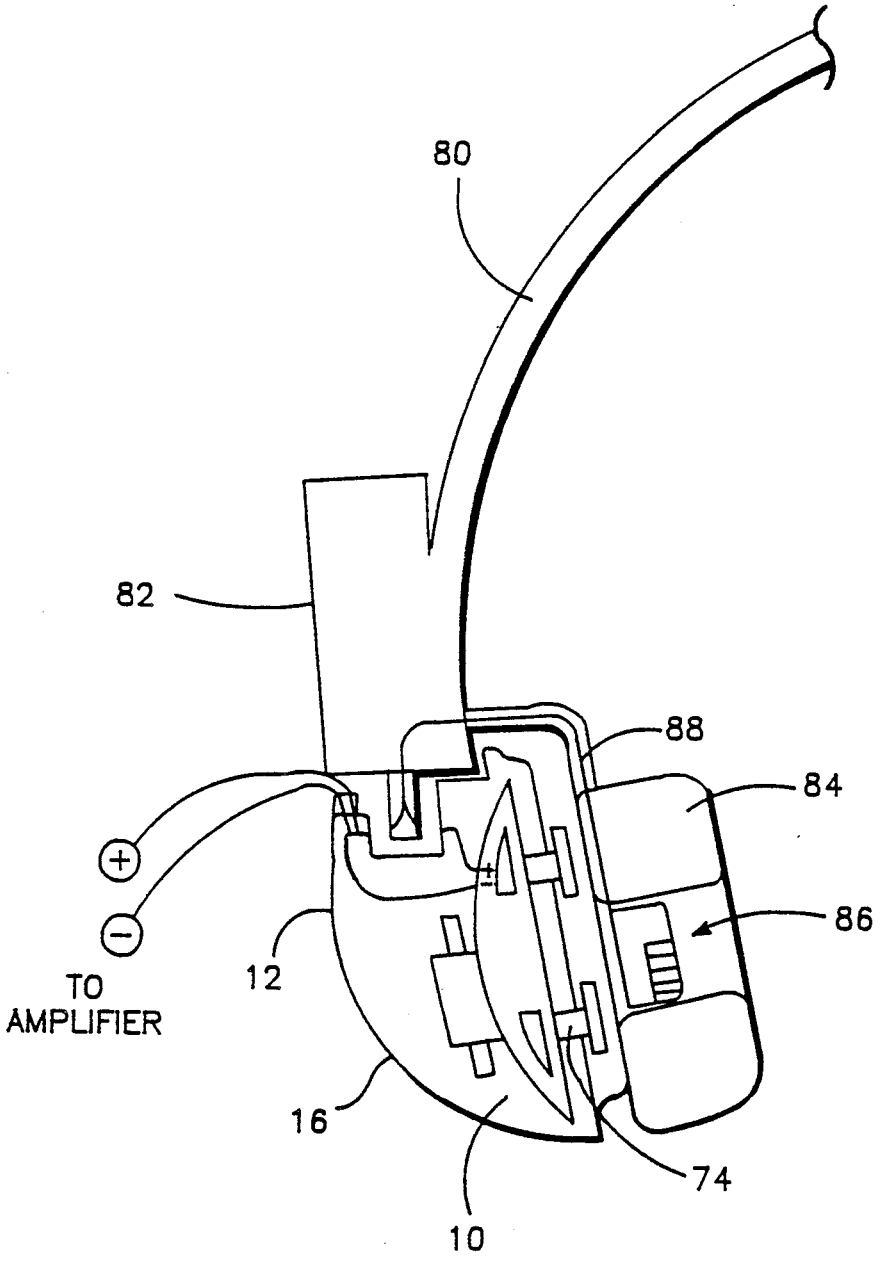
FIG. 5B is a cross section view of one of the speakers of FIG. 5A taken along the 7—7' axis and showing the speaker driver and vibrational mechanism inside the housing.

Referring now to FIG. 5B, a miniature speaker 86, driven by an amplifier (not shown) via speaker wire 88, is implanted within ear pad 84. Speaker 86 is engaged to rest adjacent the ear canal of the listener. The speaker combination including speaker 10 and miniature speaker 86 act together to generate the sound and vibrations for the listener. The vibration intensity of loud speaker 10 and the volume of speaker 86 are independently controlled by a volume control circuit (not shown) to provide flexible control to the user. For example, the user can feel high intensity vibration from loud speaker 10 while listening to low volume sounds from speaker 86.

Figure 6A:
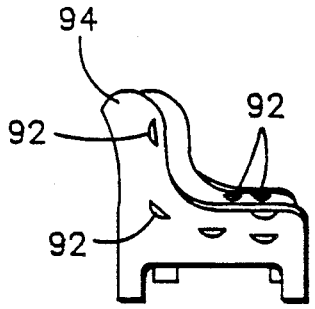
FIGS. 6A–6E illustrate applications of the speakers in accordance with the invention.
Figure 6B:
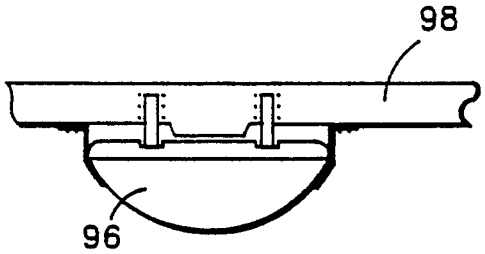
Figure 6C:
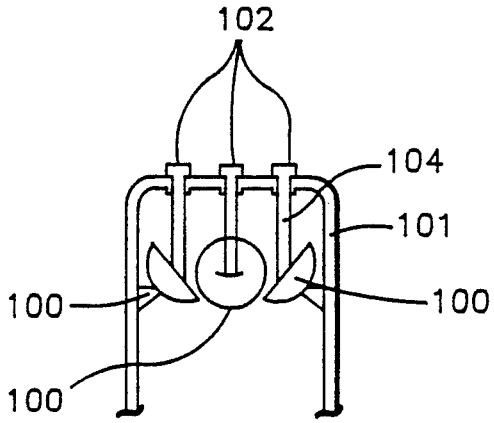
Figure 6D:
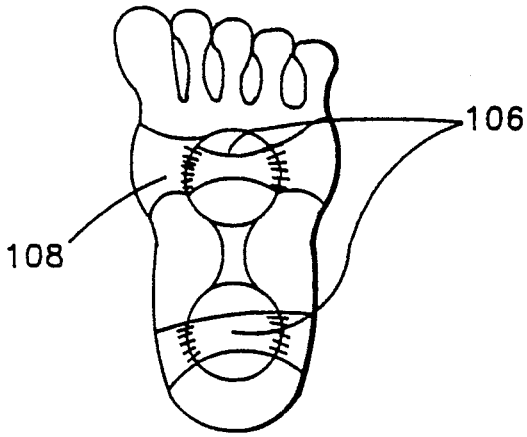
Figure 6E:
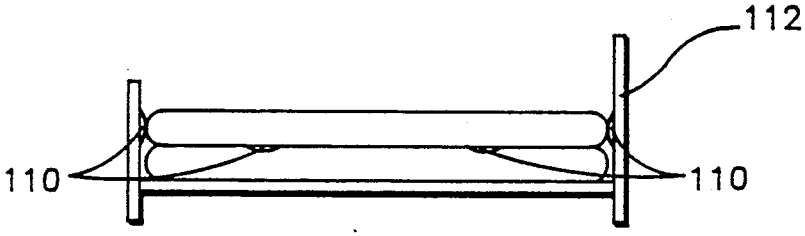

FIGS. 6A–6E illustrate several other applications of the speakers in accordance with the invention. In FIG. 6A, the speakers are attached to the back and arms of a chair 94. In FIG. 6B, a speaker 96 is attached to a desk top 98. In FIG. 6C, three speakers 100 of different diameters and with each having its own equalizer to balance out the bass treble set are attached to a chair arm 101. Thus, three sensor buttons 102 on the chair arm can provide each finger different vibration. In FIG. 6D, speakers 106 are mounted on a foot by slipping the speaker into a sock 108. Thus, the vibration of the speaker can propagate to the foot. In FIG. 6E, speakers 110 are mounted in a bed frame.

While the present invention has been described with reference to a few specific embodiments, the description is illustrative of the invention and is not to be construed as limiting the invention. Various modifications may be made to those skilled in the art without departing from the true spirit and scope of the invention as defined by the appended claims.

What is claimed is:

1. Apparatus for transmitting vibrations from a loud speaker, comprising:
   - a loud speaker including a speaker cone for generating vibrations during operation of said loud speaker;
   - a housing for supporting and enclosing said speaker, said housing having a wall; and
   - at least one vibration propagation member having a first end in contact with said speaker cone for generating vibrations in said propagation member, said propagation member is extending through the wall of said housing to transfer the vibrations of said speaker cone out of said housing.

2. The apparatus of claim 1, further comprising:
   - means for propagating said vibrations of said propagation member to the wall of said housing to cause the wall to vibrate with the vibrations of said speaker cone.

3. The apparatus of claim 2, wherein said means for propagating is a tube in the wall of said housing, said propagation member extending out of said housing through said tube, said tube being of a vibration transmitting material.

4. The apparatus of claim 3, in which said housing is shaped to fit against a bodily appendage of a user.

5. The apparatus of claim 3, further comprising;
   - an outside cover of vibration non-transmitting material for insulating the vibration of said housing.

6. The apparatus of claim I, further comprising:
   - means for insulating the vibrations of said propagation member from said housing.

7. The apparatus of claim 6, wherein said insulating means is a tube in the wall of said housing, wherein said propagation member extends through said tube, said tube being of vibration non-transmitting material.

8. The apparatus of claim 1, wherein said housing has holes on it for displacing air during said vibrations of said speaker cone.

9. The apparatus of claim 1, wherein said housing is vibration non-transmitting material.

10. An apparatus for transmitting vibrations generated with a loud speaker, the apparatus comprising:
   - a loud speaker including a speaker cone for generating vibrations during operation of said loud speaker;
   - a housing for supporting and enclosing said loud speaker in a vacuum, said housing having a vibrational surface; and
   - at least one propagation member having a first end in contact with said speaker cone for generating vibrations on said propagation member and a second, vibration transmitting end.

11. The apparatus of claim 10, wherein said housing includes a valve for removing air to create the vacuum.

12. The apparatus of claim 10, further comprising:
   - means for propagating the vibrations of said propagation member to said housing to cause said housing to vibrate in harmony with the vibrations of said speaker cone.

13. The apparatus of claim 12, wherein said propagating means comprising:
   - at least one hollow protrusion located on an inside surface of said housing; and
   - wherein said propagation member extends into said at least one hollow protrusion so that the vibrations of said propagation member are transferred into said housing through said protrusion.

14. The apparatus of claim 10, further comprising:
   - fixing means for attaching said apparatus to a support.

15. The apparatus of claim 14, wherein said fixing means is a threaded member.

16. The apparatus of claim 14, wherein said apparatus is attached with said fixing means to a chair.

17. The apparatus of claim 14, wherein said apparatus is attached with said fixing means to a desk.

18. The apparatus of claim 13, further comprising:
   - a secondary audible speaker located outside of said housing; and
   - a control means for independently controlling magnitude of the vibrations of said loud speaker inside said housing and magnitude of sound of said secondary audible speaker.

19. The apparatus device of claim 18, wherein said secondary audible speaker is a miniature speaker, said apparatus further comprising:
   - a head set;
   - an ear pad supported by said head set; and
   - wherein said ear pad being adapted to fit between said loud speaker housing and the ear of the user and contacting said housing to propagate vibrations from said speaker cone to said ear pad, said pad further holding said miniature speaker adjacent to the ear canal of the user.

* * * * *